United States Patent [19]

Seifers

[11] 4,253,094

[45] Feb. 24, 1981

[54] TIMED ALARMING USING LOGICAL INVERTERS

[76] Inventor: Monte G. Seifers, 2 Vantage Way, Nashville, Tenn. 37228

[21] Appl. No.: 125,256

[22] Filed: Feb. 28, 1980

[51] Int. Cl.[3] ..... G08B 13/22

[52] U.S. Cl. ..... 340/659; 340/529; 340/644; 340/653; 340/309.1

[58] Field of Search ..... 340/309.1, 500, 501, 340/526, 527, 529, 540, 635, 644, 652, 653, 659

[56] References Cited

U.S. PATENT DOCUMENTS 4,136,334 1/1979 Seifers ..... 340/529

*Primary Examiner*—Alvin H. Waring

*Attorney, Agent, or Firm*—Charles Hieken

[57] ABSTRACT

A triggered before disarmed alarm system uses CMOS circuitry having a hex-inverter integrated circuit with the output logical inverter coupled to the output transistor by a timing circuit that may be selected through control of the presence and absence of a D.C. operating potential to selectively provide pulsating or continuous potential, respectively, to the output transistor that renders the output transistor intermittently and continuously conductive, respectively, in the presence of an alarm signal. Intercoupling circuitry includes resistance capacitance networks with the capacitance shunted by Zener diodes having a voltage rating corresponding substantially to the voltage rating of the capacitance shunted.

2 Claims, 1 Drawing Figure

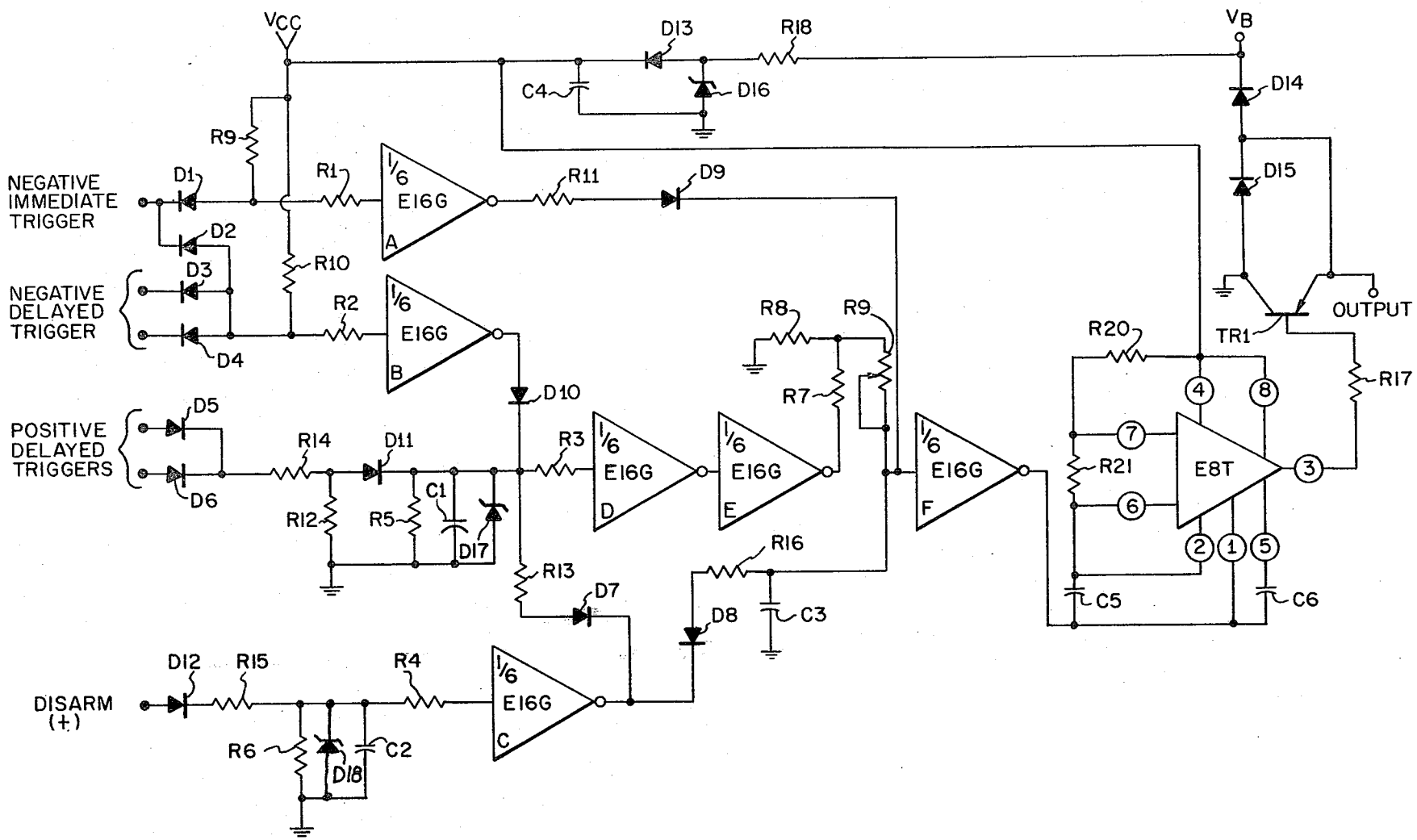
VB
D14
D15
OUTPUT
TR1
R17
E8T
C6
C5
R20
R21
E16G
F
R9
R7
R8
E16G
E
R16
C3
D8
R18
D16
D13
C4
D9
R11
E16G
D
D7
R3
R13
D10
E16G
C
E16G
A
E16G
B
D17
C1
R5
D11
R14
R12
R4
C2
D18
R6
R15
D12
VCC
R1
R10
R2
R9
D1
D2
D3
D4
D5
D6
NEGATIVE IMMEDIATE TRIGGER
NEGATIVE DELAYED TRIGGER
POSITIVE DELAYED TRIGGERS
DISARM (+)

TIMED ALARMING USING LOGICAL INVERTERS

BACKGROUND OF THE INVENTION

The present invention relates in general to alarming and more particularly concerns an improvement of the invention of Monte G. Seifers disclosed in U.S. Pat. No. 4,136,334 granted Jan. 23, 1979, for TIMED ALARMING USING LOGICAL INVERTERS. This improvement selectively provides a continuous or pulsed alarm signal and includes means for preventing damage to relatively low voltage capacitors by high voltage transients caused by inductive load dump in the vehicle in which the alarm is installed.

The aforesaid patent discloses improved apparatus for interdependent timing mechanisms that create a triggered before disarmed alarm system with automatic reset that dissipates negligible power in the rest condition. The alarm signal there provided is a continuous alarm that restricts the time in which a horn or other warming device operated by the vehicle battery may sound the alarm condition. Yet, the provision of a continuous alarm signal may be desirable, for example, when the audible signal is provided by an electronic siren. A problem with the prior art alarm circuit was that occasionally capacitors became defective after installation. It was discovered that the cause of this problem was inductive load dump producing a high voltage transient when a battery cable was connected or disconnected.

Accordingly, it is an important object of this invention to provide an improvement of the aforesaid patented invention.

It is a further object of the invention to achieve the preceding object while allowing the selection of either continuous or pulsed alarm signals.

It is a further object of the invention to achieve one or more of the preceding objects while preventing low voltage capacitors from being damaged by high voltage transients caused by inductive load dumping.

SUMMARY OF THE INVENTION

According to the invention, in alarm circuitry of the type disclosed in U.S. Pat. No. 4,136,334, an improvement resides in having a timer circuit that intercouples an output logical inverter providing an alarm signal and a normally conductive output transistor so that delivery of an energizing potential to the timer circuit pulses the output transistor upon the occurrence of an alarm signal while absence of that energizing potential from the timer circuitry causes the latter to deliver the alarm signal provided by the output logical inverter to the output power transistor to then produce a steady output current upon the occurrence of an alarm signal. Another feature of the invention resides in shunting capacitors connected between a common terminal at ground potential and a node above ground potential by Zener diodes.

BRIEF DESCRIPTION OF THE DRAWING

Numerous other features, objects and advantages of the invention will become apparent from the following specification when read in connection with the accompanying drawing, the single FIGURE of which is a diagram showing the logical and electrical arrangement of an embodiment of the invention.

DETAILED DESCRIPTION OF PREFERRED EMBODIMENTS

Referring to the drawing, there is shown a schematic circuit diagram of an exemplary embodiment of the invention corresponding substantially to the circuit shown in U.S. Pat. No. 4,136,334 with the following changes. Capacitors C1 and C2 are shunted by Zener diodes D17 and D18, respectively, of breakdown voltage preferably no greater than the voltage rating of capacitors C1 and C2 for limiting the peak voltage across the capacitors accordingly. Timer circuit E8T is connected between the output of logical inverter F and resistor R17 as shown. When connected as shown, the occurrence of an alarm signal at the output of logical inverter F causes timer circuit E8T to oscillate and deliver a pulsating signal to the base of normally nonconductive output transistor TR1 to correspondingly produce a pulsating signal at the output for operating an alarm indicator, such as a horn or horn relay. When the line delivering a D.C. potential $V_{cc}$ to terminal 4 of timer circuit E8T provides a D.C. path between terminals 1 and 3 to render output power transistor TR1 continuously conductive in the presence of an alarm signal.

The pulsating alarm signal is advantageous for use with vehicles having means for disabling the vehicle horn when operated longer than a predetermined time interval that is less than desired when an actual alarm condition occurs. For better understanding the invention there is reproduced below portions of U.S. Pat. No. 4,136,334.

Referring to the drawing, there is shown a schematic circuit diagram of an exemplary embodiment of the invention. Zener diode D16 and associated circuitry comprise means for converting the battery potential $V_B$ of a typical automobile into a regulated filtered potential $V_{cc}$. The positive and negative delayed triggers inputs, which may be generated when a door is opened, produce an alarm condition on the output unless a disarm potential is applied to the disarm input within a predetermined interval while the negative immediate trigger input produces an alarm condition on the output in response to a condition, such as opening the hood or trunk, in the absence of a disarm potential on the disarm input. The A portion of the E16G hex-inverter and associated circuitry couples the negative immediate trigger input to the input of the output inverter F coupled to the base of the normally nonconductive output transistor $TR_1$.

Diode $D_2$ also couples the negative immediate trigger input to the input of the B inverter that also receives negative delayed triggers provided through diodes $D_3$ and $D_4$ and is coupled by diode D10 to the input of the cascaded D and E inverters which, when enabled in the absence of a disarm potential, provide a signal to the output inverter F that renders the output transistor $TR_1$ conductive. Diodes $D_5$, $D_6$ and $D_{11}$ and associated circuitry couple positive delayed triggers to the input of the cascaded D and E inverters. Diode D12 and associated circuitry couples the disarm potential on the disarm input to the input of the C inverter to disable that D, E and F inverters when the disarm potential is present, resistor $R_6$ and capacitor $C_2$ comprising a delay network for keeping the latter inverters disabled for a time interval sufficient to enable a person to leave a car, for example, after removing the disarm potential.

The specific means for providing the various triggers, such as door, window, hood and trunk alarm switches and a key switch for arming the alarm system are well-known in the art, not a part of the invention and not described herein to avoid obscuring the principles of the invention. Having generally described the structural arrangement of the invention, its mode of operation will be described.

The terms high and low are used in the description to denote the potential relative to ground with low being at or near ground potential and high being of sufficient potential to cause an inverter to be held in a high input condition.

(A) At standby, the disarm input is held open or at ground potential and capacitor $C_2$ is uncharged. When held at this state, the following inputs result in the described conditions:

1. If a negative delayed trigger input or a negative immediate trigger input is forced to ground potential or slightly above, the input of inverter B goes low which forces the output of B high, rapidly charging capacitor $C_1$ through diode D10 and causing the input of inverter D to go high.
2. If a positive delayed trigger input is forced high, capacitor $C_1$ is charged through resistor R14 and diode D11, again causing the input of inverter D to go high.
3. When the input of inverter D is high, the output of inverter E is forced high, and capacitor $C_3$ is allowed to charge through resistor $R_7$ and entry delay adjustment resistor R19. After capacitor $C_3$ reaches sufficient potential, the output of inverter F goes low which causes output transistor TR1 to conduct from emitter to collector. This ground supply output may be used to drive a relay that may, for example, disable the automobile ignition.
4. If the negative immediate trigger input has been forced low, then capacitor $C_3$ is rapidly charged through resistor R11 and diode $D_9$, causing an effectively immediate output response.
5. After trigger inputs are removed, capacitor $C_1$ is allowed to discharge through resistor $R_5$ having other paths of discharge blocked by diodes D10 and D11, the high output state of inverter C and the enormously high input impedance of inverter D. This slow discharge holds the input of inverter D at its high state which in turn holds the output of inverter E high and, assuming $C_3$ has reached sufficient potential, holds the output of inverter F low which causes conduction of output transistor TR1.

(B) When the disarm input is forced high, capacitor $C_2$ is rapidly charged through diode D12 and resistor D15, causing the output of inverter C to go low.

After the disarm input is removed, capacitor $C_2$ is allowed to discharge through resistor $R_6$, having other-paths of discharge being blocked by diode D12 and the enormously high input impedance of inverter C. This slow discharge holds the output of inverter C at its low state which in turn causes the input of inverter F to be forced low which results in no output condition. Also, capacitors $C_1$ and $C_3$ are discharged through resistor R13, diode $D_7$ and resistor R16, diode $D_8$ respectively. Capacitors $C_1$ and $C_3$ are not permitted to charge to high potential until the output of inverter C goes high. This allows a means of providing an exit delay disarm before standby condition is established.

There has been described improved novel apparatus and techniques for economically and reliably providing a trigger before disarmed alarm system with automatic reset to standby after all input triggers are set to normal and predetermined amount of time transpired with reliable economical compact circuitry that dissipates negligible power in the rest condition, the improvements including preventing damage to low voltage capacitors in the presence of high voltage transients caused by inductive load dump and a means for allowing the selection of either a pulsating or continuous high level alarm output signal for driving the alarm indicating device. Table I sets forth specific parameter values in a preferred embodiment.

TABLE I

| | |
|---|---|
| E8T | CA555 TIMER |
| E16G | 4049 CMOS IC |
| TR1 | T1P30 PNP POWER TRANSISTOR |
| D16–D18 | 1N5245 15v 500mw ZENER DIODE |
| D13–D15 | 1N4001 DIODE |
| D10–D12 | 1N914 or 1N4148 DIODE |
| D1–D9 | CA3141E DIODE ARRAY |
| C6 | 0.01 mfd 25 volt CERAMIC DISC CAP. |
| C5 | 0.47 mfd 15 volt ELECTROLYTIC CAP. |
| C1–C4 | 50 mfd 15 volt ELECTROLYTIC CAP. |
| R21 | 1M OHM ¼ WATT RESISTOR |
| R20 | 300 K OHM ¼ WATT RESISTOR |
| R19 | 500 K OHM POTENTIOMETER |
| R18 | 100 OHM ¼ WATT RESISTOR |
| R17 | 500 OHM ¼ WATT RESISTOR |
| R14–R16 | 1.0 K OHM ¼ WATT RESISTOR |
| R12–R13 | 4.7 K OHM ¼ WATT RESISTOR |
| R9–R11 | 10 K OHM ¼ WATT RESISTOR |
| R8 | 100 K OHM ¼ WATT RESISTOR |
| R7 | 47 K OHM ¼ WATT RESISTOR |
| R1–R6 | 2.2 MEGOHM ¼ WATT RESISTOR |

It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In alarm circuitry having an intermediate trigger input for receiving a signal for causing an immediate alarm condition in the absence of a disarm signal, at least one delayed trigger input for receiving an alarm trigger signal for providing an alarm condition only if a disarm signal remains absent for a predetermined time interval, a disarm input for receiving said disarm signal, an output logical inverter means for providing an alarm signal only in response to the occurrence of an immediate trigger signal on said intermediate trigger input concurrently with the absence of a disarm signal on said disarm input and/or the occurrence of a delayed trigger signal on said delayed trigger input and the absence of a disarm signal on said disarm input outside a predetermined delay interval and means consisting only of diodes, resistors, capacitors and inverters for intercoupling said inputs and said output inverter, and a normally nonconductive output transistor for providing an output current only upon occurrence of an alarm signal, the improvement comprising, a source of D.C. operating potentials, timing circuit means intercoupling said output logical inverter means and said output transistor for providing a pulsed signal to said output transistor to produce a pulsating output current therefrom and energized with said D.C. operating potentials when said output logical inverter means provides an alarm signal and being in a D.C. path between said output logical inverter means and said output transistor for providing a D.C. signal to said output transistor that renders the latter continuously conductive when said output logical inverter means provides an alarm signal and said timing circuit is free of D.C. energizing potentials.

2. The improvement in accordance with claim 1 wherein said means for intercoupling includes at least a resistor capacitance network direct coupled to the input of inverter and Zener diode means connected across the latter capacitance for limiting the voltage applied across said capacitance to a potential that is less than the breakdown potential of said capacitance.

* * * * *